US006604543B1

(12) United States Patent
Guo

(10) Patent No.: US 6,604,543 B1
(45) Date of Patent: Aug. 12, 2003

(54) HOSE SUPPORTING SPOOL DEVICE HAVING ROTATABLE COUPLING

(76) Inventor: Wen Li Guo, No. 10, Fang Dong Road, Wen Gin Tsuen, Fang Yuan Hsiang, Chang Hua Hsien (TW), 502

( * ) Notice: Subject to any disclaimer, the term of this patent is extended or adjusted under 35 U.S.C. 154(b) by 0 days.

(21) Appl. No.: 10/090,200

(22) Filed: Mar. 5, 2002

(51) Int. Cl.[7] ..... B65H 75/34

(52) U.S. Cl. ..... 137/355.27; 137/355.26; 137/580; 285/148.4

(58) Field of Search ..... 137/355.26, 580, 137/355.27; 285/144.1, 148.4

(56) References Cited

U.S. PATENT DOCUMENTS 4,506,698 A * 3/1985 Garcia et al. ..... 137/355.27
4,512,361 A * 4/1985 Tisbo et al. ..... 137/355.27
4,823,835 A * 4/1989 Chu ..... 137/557
5,787,923 A * 8/1998 Shea et al. ..... 137/355.26

* cited by examiner

*Primary Examiner*—A. Michael Chambers
(74) *Attorney, Agent, or Firm*—Charles E. Baxley

(57) ABSTRACT

A hose supporting spool device includes a spool rotatably secured to a support device for winding a hose, a shaft secured to the support device and having a passage, a block formed on the shaft and having a peripheral slot and one or more grooves communicating the peripheral slot of the block with the passage of the shaft. A housing is rotatably engaged onto the block and the shaft and has a mouth coupled to a water reservoir. Two gaskets are engaged on the sides of the block and have curved recesses for receiving the curved outer portions of the block.

11 Claims, 5 Drawing Sheets

HOSE SUPPORTING SPOOL DEVICE HAVING ROTATABLE COUPLING

BACKGROUND OF THE INVENTION

1. Field of the Invention

The present invention relates to a hose supporting spool device, and more particularly to a hose supporting spool device having a rotatable coupling device.

2. Description of the Prior Art

Typical hose supporting spool devices comprise a rotatable shaft for allowing the hose to be wound around the shaft. However, the hose will be difficult to be coupled to the water supply, because the shaft is rotatable relative to a supporting frame.

The present invention has arisen to mitigate and/or obviate the afore-described disadvantages of the conventional hose supporting spool devices.

SUMMARY OF THE INVENTION

The primary objective of the present invention is to provide a hose supporting spool device including a rotatable coupling device for allowing the hose to be solidly coupled to the water supply.

The other objective of the present invention is to provide a hose supporting spool device including a rotatable coupling device for preventing a pipe coupled between the support device of the hose and the water supply to be twisted.

In accordance with one aspect of the invention, there is provided a hose supporting spool device comprising a support device, a spool rotatably secured to the support device, a hose wound around the spool, a shaft secured to the support device and including a passage formed therein, a block formed on the shaft and including a peripheral slot formed therein, and including at least one groove formed therein and communicating the peripheral slot of the block with the passage of the shaft, a housing including a chamber formed therein for rotatably receiving the block and the shaft, and for allowing the housing to be rotatably engaged onto the block and the shaft, the housing including a mouth provided therein and communicating with the chamber thereof, means for making a water tight seal between the block and the housing, and a first coupler coupled to the mouth of the housing for coupling the housing to a water reservoir.

The water tight seal making means includes at least one gasket engaged on the shaft and engaged with the block and the housing for making the water tight seal between the block and the housing.

The block includes two curved outer portions, the water tight seal making means includes two gaskets engaged on the shaft and each having a curved recess formed therein for engaging with the curved outer portions of the block.

A device is further provided for retaining the block in the housing and includes a cover having a bore formed therein for receiving the shaft, the cover is threaded to the housing and engaged with the gaskets for retaining the gaskets and the block in the housing.

The housing includes a first end having an opening formed therein, the shaft includes a first end threaded to the support device, and includes a second end extended through the opening of the housing and having an engaging hole formed therein for receiving a driving tool.

A barrel is further provided and includes a bore formed therein and includes a peripheral flange extended inward of the bore thereof and includes an inner thread formed therein, a plate received in the bore of the barrel and engaged with the peripheral flange of the barrel and includes a threaded portion engaged through the barrel and threaded to the mouth and includes a bore communicating with the peripheral slot of the block, the first coupler being threaded to the inner thread of the barrel.

The support device includes a frame, the spool includes a tube rotatably coupled to the frame and having two ends, and includes two panels extended from the ends of the tube.

The frame includes an orifice formed therein, a duct is engaged into the orifice of the frame and secured to the frame and includes an inner thread formed therein for threading with the shaft.

The spool includes a cap secured to a first of the ends of the tube, a port extended from the cap and rotatably engaged in the duct, and a second coupler extended from the cap for coupling the duct to the hose.

The tube includes an aperture formed therein, the second coupler is received in the tube and engaged through the aperture of the tube and coupled to the hose.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
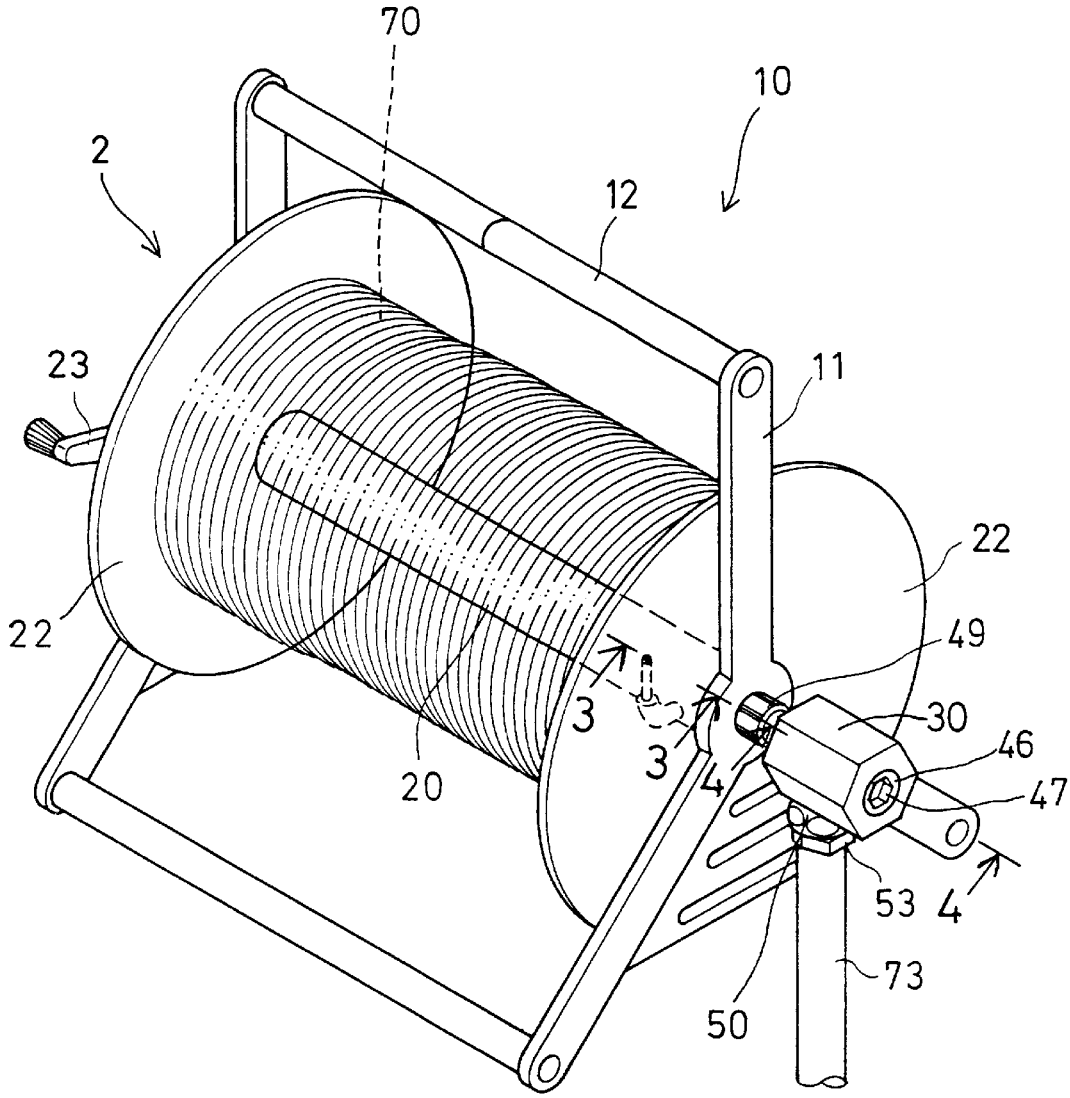
FIG. 1 is a partial perspective view of a hose supporting spool device in accordance with the present invention.
Figure 2:
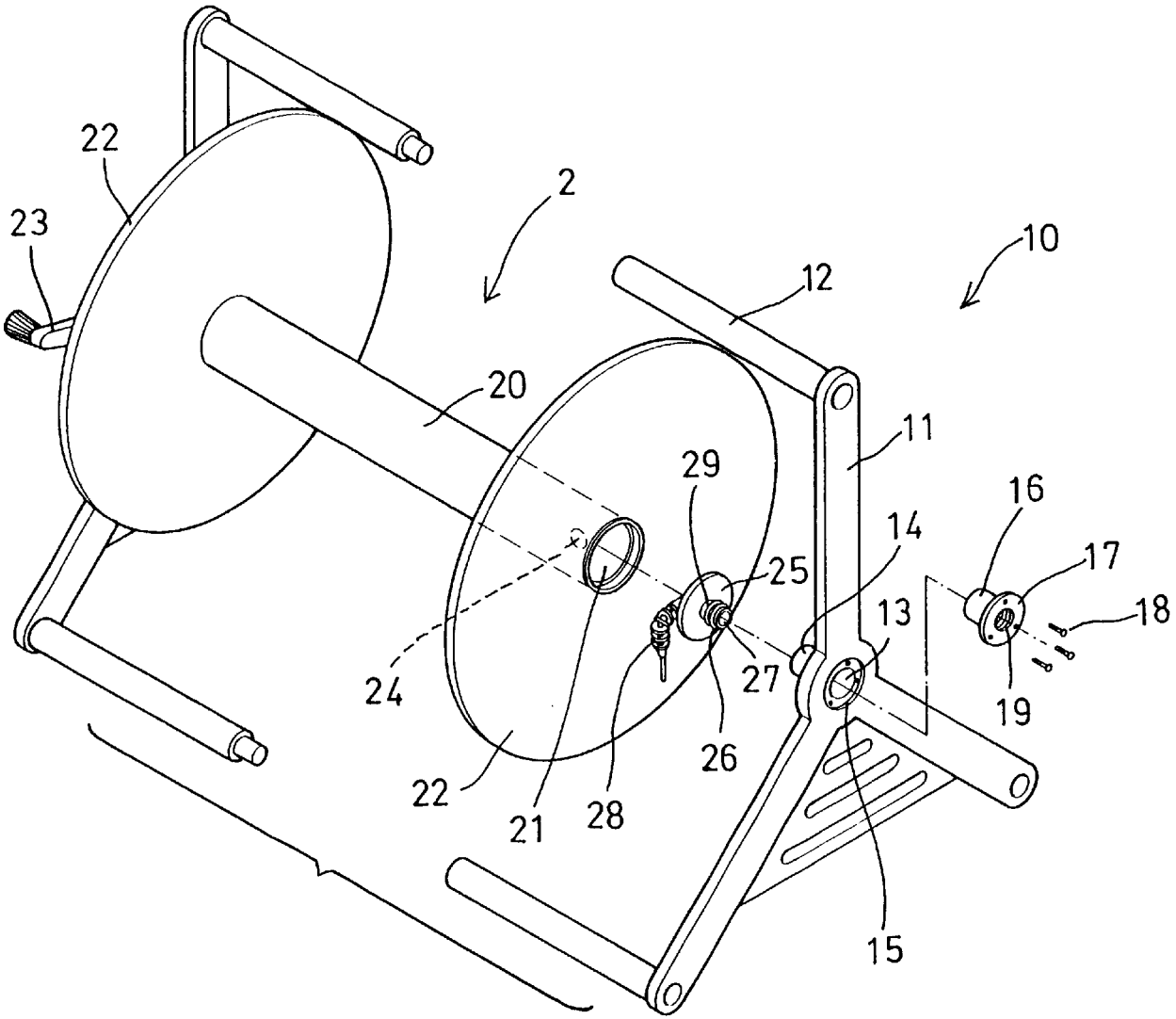
FIG. 2 is a partial exploded view of the hose supporting spool device.
Figure 3:
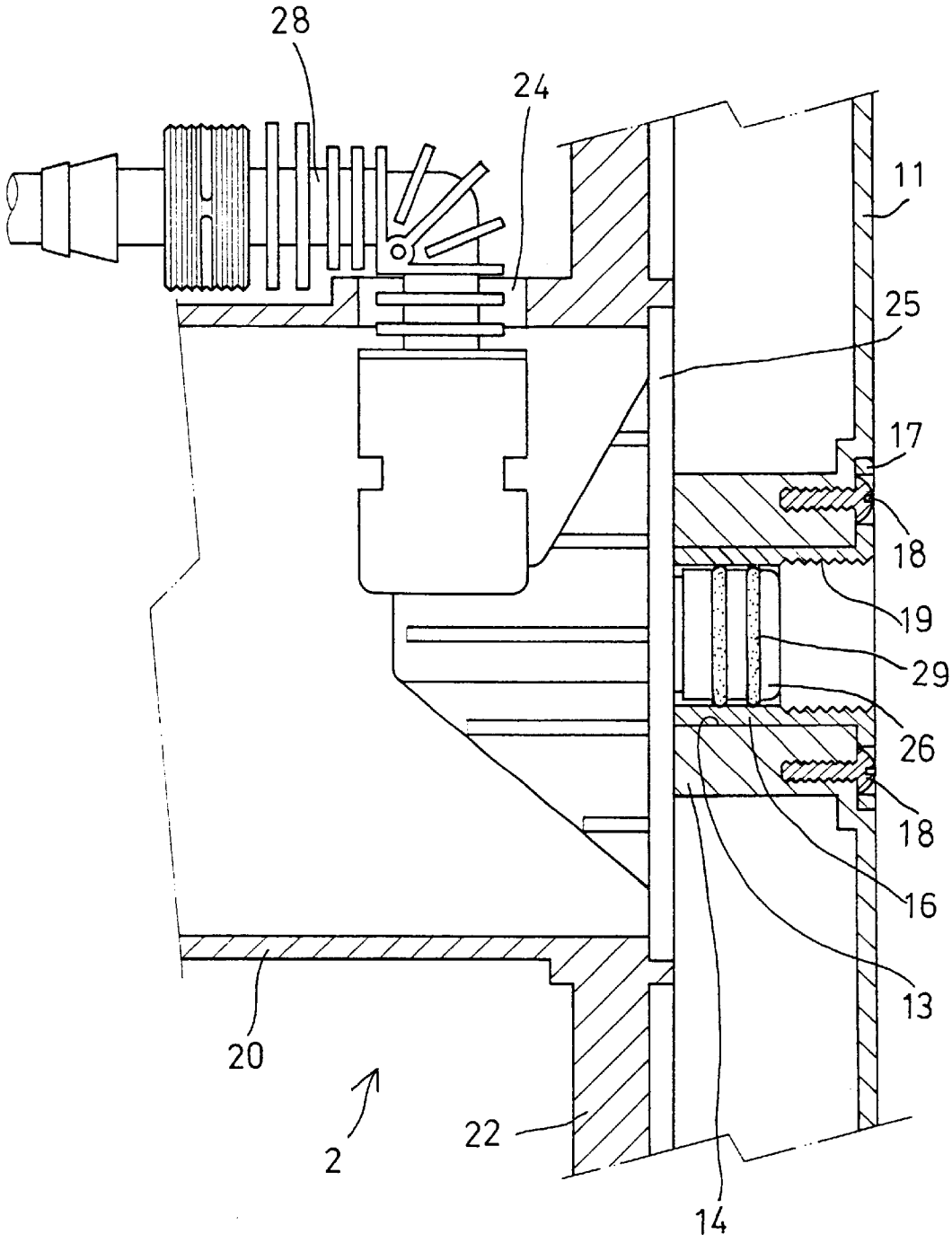
FIGS. 3, 4 are partial cross sectional views taken along lines 3—3, 4—4 of FIG. 1 respectively.

Referring to the drawings, and initially to FIGS. 1–3, a hose supporting spool device in accordance with the present invention comprises a support device 10 including a pair of side frames 11, such as the inverted Y-shaped frames 11, secured together with connecting rods 12. One of the frames 11 includes an orifice 13 formed in or through the middle portion thereof, and formed or defined by a conduit 14 that is extended toward the other frame 11, and includes a depression 15 formed in the outer portion thereof and communicating with the orifice 13 thereof. A duct 16 is engaged into the orifice 13 of the frame 11, and includes a side flange 17 engaged into the depression 15 of the frame 11 and secured to the frame 11 with fasteners 18, and includes a screw hole 19 formed therein, such as formed in the outer portion thereof, best shown in FIG. 3.

A spool 2 includes a tube 20 rotatably secured between the side frames 11 with such as pivot axles or the like, and includes two panels 22 extended radially outward from the sides or the ends of the tube 20, for forming or defining a peripheral chamber around the tube 20 and for receiving the hose 70 to be wound and received in the spool. A handle 23 may be secured to the tube 20 or to the axles for rotating the tube 20 relative to the frames 11 of the support device 10. The tube 20 includes an aperture 24 formed in one end thereof and communicating with the bore 21 of the tube 20.

A disc or a cap 25 is secured in one end of the tube 20 with such as a force-fitted engagement, or with a threaded engagement, or with fasteners or adhesive materials, or by welding processes, and includes a port 26 extended therefrom, such as extended from the outer portion thereof for engaging into the conduit 14 or the duct 16, particularly the inner portion of the duct 16, and includes an aperture 27 formed therein and formed through the cap 25, and includes a coupler 28 provided or extended or disposed in the inner portion thereof and engaged through the aperture 24 of the tube 20 for coupling to the hose 70 (FIG. 1) that is to be wound around the tube 20, such that the hose 70 may be coupled to the port 26. The port 26 is rotatably received in the duct 16 such that the port 26 may also be used for rotatably coupling the tube 20 to the frame 11. As best shown in FIG. 3, the port 26 is rotatably received in the duct 16, and one or more sealing rings 29 may be provided and engaged between the port 26 and the duct 16 for making a water tight seal between the port 26 and the duct 16 even when the port 26 is rotated relative to the duct 16, and when the tube 20 is rotated relative to the frames 11 of the support device 10.

Referring next to FIGS. 4, 5 and again to FIG. 1, a housing 30 is provided and includes a chamber 36 formed therein, and includes an opening 31 formed in one side or one end thereof and communicating with the chamber 36 thereof, and includes an inner thread 32 formed in the other end thereof, and includes a threaded mouth 35 formed in the lower portion thereof and communicating with the chamber 36 of the housing 30.

Figure 4:
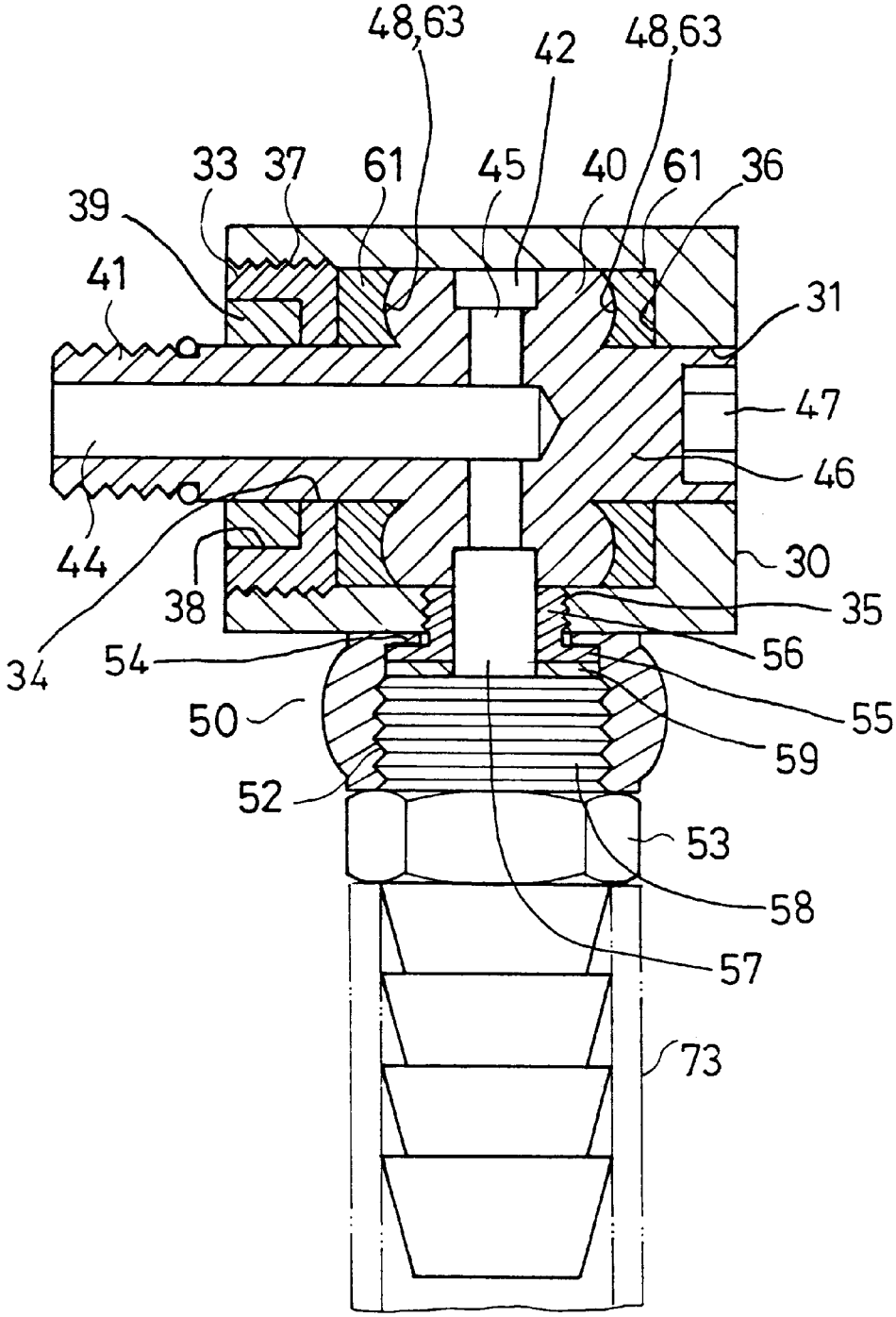
Figure 5:
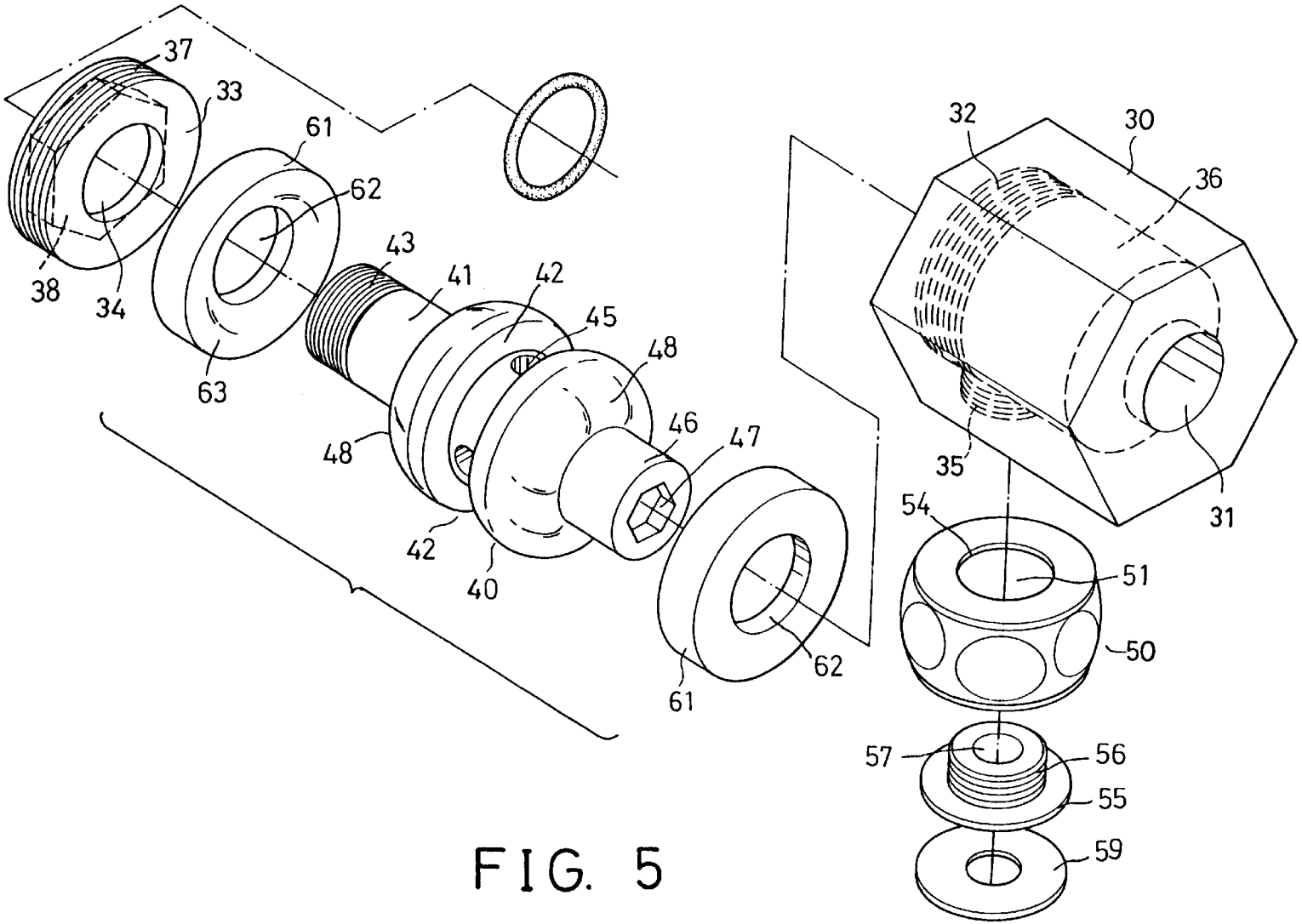
FIG. 5 is a partial exploded view illustrating the rotatable coupling of the hose supporting spool device.

A block 40 is provided or formed or disposed on a shaft 41, and includes a peripheral slot 42 formed in the outer peripheral portion thereof, and preferably includes a curved outer portion 48 formed on each of the side portions thereof. The block 40 preferably includes an outer diameter equals to the inner diameter of the chamber 36 of the housing 30 for allowing the block 40 to be rotatably and snugly received in the chamber 36 of the housing 30 (FIG. 4). Two washers or gaskets 61 are preferably made of teflon materials, and each has a bore 62 formed therein for receiving the shaft 41 and for allowing the gaskets 61 to be engaged onto the shaft 41 and engaged with the block 40 and the housing 30, and each includes a curved recess 63 formed therein for receiving the curved outer portions 48 of the block 40, and for making a water tight seal between the shaft 41 and the block 40 and the housing 30 even when the shaft 41 and the block 40 are rotated relative to the housing 30.

The shaft 41 includes an outer thread 43 formed on one end thereof and extended outward of the housing 30 for threading and securing to the screw hole 19 of the duct 16, such that the shaft 41 and the block 40 may be secured to the duct 16 and the frame 11. The housing 30 may be rotated relative to the block 40 and the shaft 41. A lock nut 49 (FIG. 1) may be threaded onto the outer thread 43 of the shaft 41 and engaged with the frame 11 for locking the shaft 41 to the frame 11. The shaft 41 includes a passage 44 formed therein, and the block 40 includes one or more grooves 45 formed therein and communicating with the passage 44 of the shaft 41 and the peripheral slot 42 of the block 40. The passage 44 of the shaft 41 may thus be coupled to or communicated with the port 26, for allowing the hose 70 to be coupled to the shaft 41 and the block 40.

A cover 33 includes a bore 34 formed therein for receiving the shaft 41 and for allowing the cover 33 to be engaged onto the shaft 41, and includes an outer thread 37 formed on the outer peripheral portion thereof for threading with the inner thread 32 of the housing 30 and for allowing the cover 33 to be threaded and engaged into the chamber 36 of the housing 30. The cover 33 may be engaged with the gasket 61 for stably and solidly retaining the gaskets 61 and the block 40 in the chamber 36 of the housing 30, and may includes a cavity 38 formed therein for receiving a washer or a gasket or an insert 39 therein (FIG. 4). The shaft 41 includes the other end 46 rotatably engaged through the opening 31 of the housing 30, and having an engaging hole 47 formed therein for receiving a driving tool which may rotate the shaft 41 relative to the duct 16 and the frame 11.

A barrel 50 includes a bore 51 formed therein, and includes a peripheral flange 54 extended radially inward of the bore 51 thereof, and includes an inner thread 52 formed therein (FIG. 4) for threading with a threaded portion 58 of a coupler 53 which may be coupled to a pipe 73 that may be coupled to the water reservoir or the like. A plate 55 is engaged in the bore 51 of the barrel 50 and engaged with the peripheral flange 54, and includes a bolt or a threaded portion 56 extended outward of the barrel 50 for threading with the threaded mouth 35 of the housing 30 and for securing the barrel 50 to the housing 30, and includes a bore 57 for coupling to or communicating with the peripheral slot 42 of the block 40, best shown in FIG. 4. A gasket or a washer 59 may be engaged between the plate 55 and the threaded portion 58 of the coupler 53.

In operation, as shown in FIGS. 1, 4, the shaft 41 is secured to the duct 16 and the frame 11. The housing 30 and the barrel 50 and the coupler 53 and the pipe 73 may be rotated relative to the shaft 41 and the block 40, such that the frames 11 or the support device 10 may be easily moved away from, the reservoir without twisting the pipe 73 relative to the support device 10. The bore 57 of the threaded portion 56 or of the plate 55 may be continuously communicated with the passage 44 of the shaft 41 via the peripheral slot 42 and the grooves 45 of the block 40 even when the block 40 and the shaft 41 are rotated relative to the housing 30 or when the housing 30 is rotated relative to the shaft 41 and the block 40. The port 26 (FIG. 3) is rotatably received in the duct 16 such that the port 26 may also be coupled to or communicated with the shaft 41 when the tube 20 and the hose 70 are rotated relative to the frames 11 of the support device 10.

Accordingly, the hose supporting spool device in accordance with the present invention includes a rotatable coupling device for allowing the hose to be solidly coupled to the water supply, and for preventing the pipe coupled between the support device of the hose and the water supply to be twisted.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A hose supporting spool device comprising:

a support device, a spool rotatably secured to said support device, a hose wound around said spool, a shaft secured to said support device and including a passage formed therein, a block formed on said shaft and including a peripheral slot formed therein, and including at least one groove formed therein and communicating said peripheral slot of said block with said passage of said shaft, a housing including a chamber formed therein for rotatably receiving said block and said shaft, and for allowing said housing to be rotatably engaged onto said block and said shaft, said housing including a mouth provided therein and communicating with said chamber thereof, means for making a water tight seal between said block and said housing, and a first coupler coupled to said mouth of said housing for coupling said housing to a water reservoir.

2. The hose supporting spool device according to claim 1, wherein said water tight seal making means includes at least one gasket engaged on said shaft and engaged with said block and said housing for making the water tight seal between said block and said housing.

3. The hose supporting spool device according to claim 1, wherein said block includes two curved outer portions, said water tight seal making means includes two gaskets engaged on said shaft and each having a curved recess formed therein for engaging with said curved outer portions of said block.

4. The hose supporting spool device according to claim 3 further comprising means for retaining said block in said housing.

5. The hose supporting spool device according to claim 4, wherein said retaining means includes a cover having a bore formed therein for receiving said shaft, said cover is threaded to said housing and engaged with said gaskets for retaining said gaskets and said block in said housing.

6. The hose supporting spool device according to claim 1, wherein said housing includes a first end having an opening formed therein, said shaft includes a first end threaded to said support device, and includes a second end extended through said opening of said housing and having an engaging hole formed therein for receiving a driving tool.

7. The hose supporting spool device according to claim 1 further comprising a barrel including a bore formed therein and including a peripheral flange extended inward of said bore thereof and including an inner thread formed therein, a plate received in said bore of said barrel and engaged with said peripheral flange of said barrel and including a threaded portion engaged through said barrel and threaded to said mouth and including a bore communicating with said peripheral slot of said block, said first coupler being threaded to said inner thread of said barrel.

8. The hose supporting spool device according to claim 1, wherein said support device includes a frame, said spool includes a tube rotatably coupled to said frame and having two ends, and includes two panels extended from said ends of said tube.

9. The hose supporting spool device according to claim 8, wherein said frame includes an orifice formed therein, a duct is engaged into said orifice of said frame and secured to said frame and includes an inner thread formed therein for threading with said shaft.

10. The hose supporting spool device according to claim 9, wherein said spool includes a cap secured to a first of said ends of said tube, a port extended from said cap and rotatably engaged in said duct, and a second coupler extended from said cap for coupling said duct to said hose.

11. The hose supporting spool device according to claim 10, wherein said tube includes an aperture formed therein, said second coupler is received in said tube and engaged through said aperture of said tube and coupled to said hose.

* * * * *